United States Patent [19]

Chen

[11] Patent Number: 5,040,793

[45] Date of Patent: Aug. 20, 1991

[54] PLASTIC AIR-FILLED BALL

[75] Inventor: Cheng-Yuan Chen, Taipei Hsien, Taiwan

[73] Assignee: Cheng Gen Plastic Co., Ltd., Taipei Hsien, Taiwan

[21] Appl. No.: 557,044

[22] Filed: Jul. 25, 1990

[51] Int. Cl.[5] ..... A63B 41/00; A63B 45/00

[52] U.S. Cl. ..... 273/58 BA; 40/327

[58] Field of Search ..... 273/58 B, 58 BA, 58 R, 273/58 C, 58 E, 58 F, 58 H, 58 J, 58 K, 61 D, 221; 40/327

[56] References Cited

U.S. PATENT DOCUMENTS 1,531,317 3/1925 Stubbs ..... 273/58 B

*Primary Examiner*—George J. Marlo

*Attorney, Agent, or Firm*—Browdy and Neimark

[57] ABSTRACT

Plastic air-filled balls comprising three identical layer pieces of plastic connected together. In the middle layer, a thru-hold is provided to balance air pressure and on either one of the other layers an air valve and plug are disposed to confine air in said ball.

2 Claims, 3 Drawing Sheets

PLASTIC AIR-FILLED BALL

BACKGROUND OF THE INVENTION

Field of the Invention

The present invention relates to plastic balls used often for advertisement, education and toys, and is composed of three identical pieces of material wherein a middle layer is provided with an air passage to keep air pressure of two chambers in balance and either one of the other layers is provided with a valve to allow air on. The three pieces can be connected by high frequency waves to form an enclosed body, so that, the preparation of the plastic ball can be simplified and the cost of manufacture can be further reduced.

The conventional air-filled ball is shown in FIG. 1, which utilizes multi-pieces of plastic material to form the same. If said ball is to be made by using six pieces, the ball will be far away from roundness; while if nine pieces are used, better roundness can be expected. Nevertheless, either the six or nine piece method wastes a lot of time in preparing the materials, and the connection will need extra attention for a multi-pieces method; therefore, the efficiency is poor and the cost is high in this respect.

SUMMARY OF THE INVENTION

Therefore, it is an objective of the present invention to improve the method of manufacture by using three pieces of identical materials, so that better roundness can be achieved with lower cost and higher precision.

PREFERRED EMBODIMENT OF THE INVENTION

Figure 1:
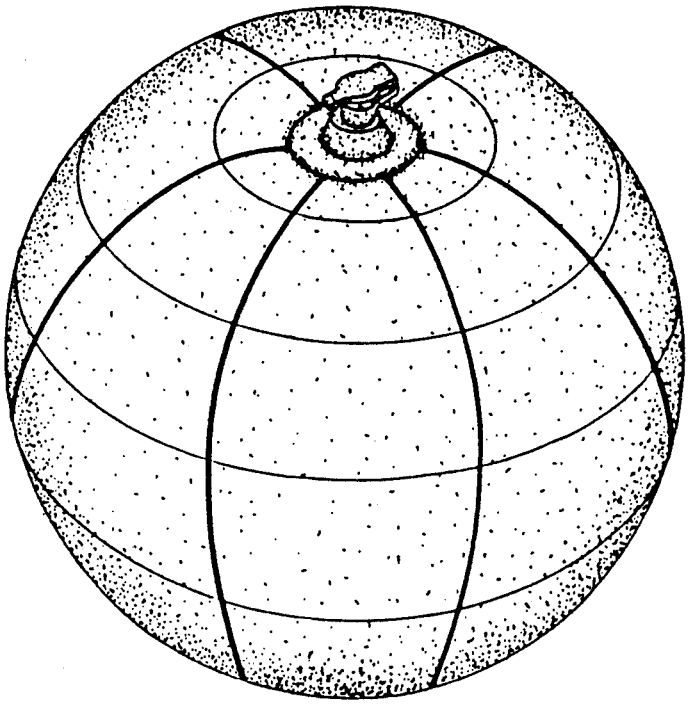
FIG. 1 is a perspective view of a conventional air-filled ball.
Figure 2:
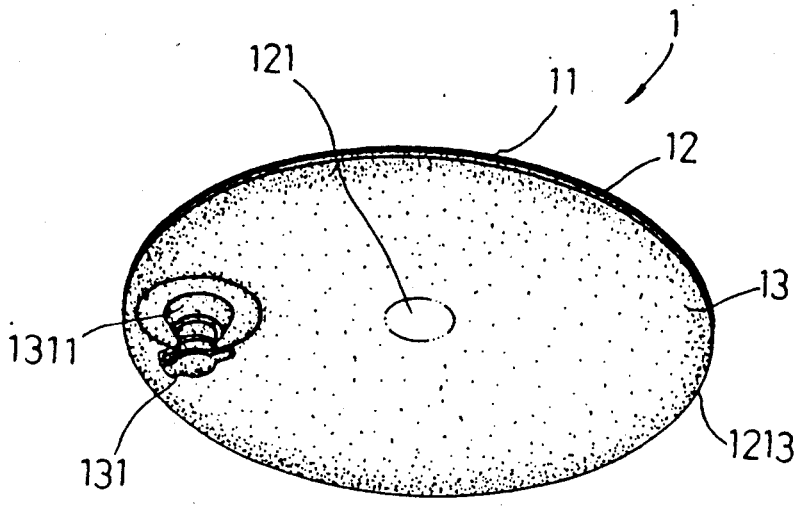
FIG. 2 is a perspective view of the present invention ball before air filling.
Figure 3:
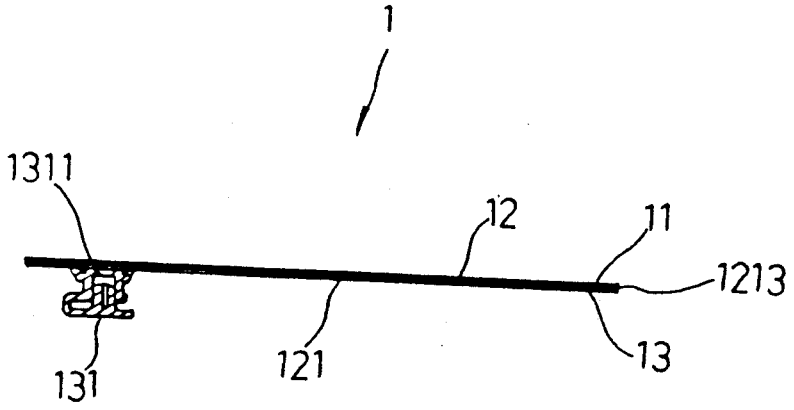
FIG. 3 is a cross-sectional view seen in the front.

FIGS. 2 and 3 of the present invention comprises an upper layer 11, middle layer 12, and lower layer 13, formed by connecting margin 1213 of said layers by means of high frequency waves. The present invention round ball has three pieces of circles and a conventional air plug or simple valve 131 is formed on either one of the outer layers (either upper layer 11 or lower layer 13) to provide a so-called one way safety valve to allow air to get in but not get out, if one does not press the base thereof. A through hole 121 is formed in middle lay 12 to keep air pressure of the two chambers in balance. Therefore, a round ball can be made by connecting three pieces of materials together.

Figure 4:
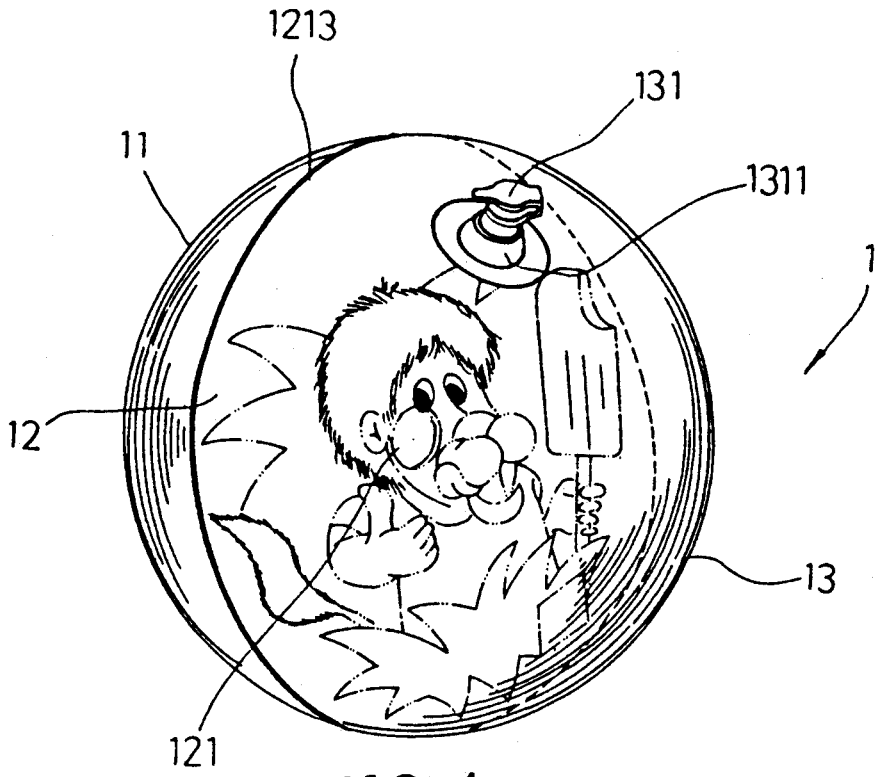
FIG. 4 is a perspective view of the present invention after air filling.
Figure 5:
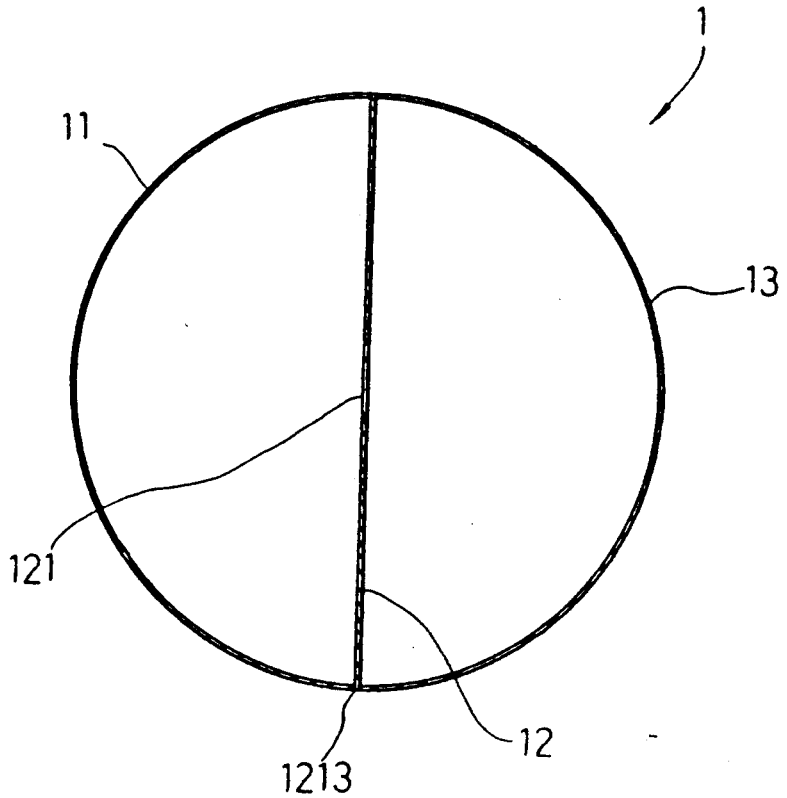
FIG. 5 is a cross-sectional view according to the present invention after air filling.

With further reference to FIG. 4 and 5, the ball can be filled by air mechanically or manually.

The present invention needs only three pieces of materials of identical size. Upon sealing the edge or margin of said layers, two chambers can be formed separately, and the middle layer can be provided with through hole to stabalized air pressure so that the process and cost for manufacturing the ball can be further reduced and provided with better precision.

I claim:

1. A air-filled ball composed of a body comprising: upper, middle, and lower layers; wherein said middle layer is provided with an air passage and either one of the other layers is provided with an air valve.

2. The air-filled ball of claim 1, wherein said body is of any geometrical shape and said layers are of identical shape.

* * * * *